US009828960B2

(12) United States Patent
Vorbach

(10) Patent No.: US 9,828,960 B2
(45) Date of Patent: Nov. 28, 2017

(54) VALVE FOR METERING A FLOWING MEDIUM

(75) Inventor: Marco Vorbach, Freiberg (DE)

(73) Assignee: ROBERT BOSCH GMBH, Stuttgart (DE)

( * ) Notice: Subject to any disclaimer, the term of this patent is extended or adjusted under 35 U.S.C. 154(b) by 244 days.

(21) Appl. No.: 14/124,995

(22) PCT Filed: Apr. 25, 2012

(86) PCT No.: PCT/EP2012/057521

§ 371 (c)(1),
(2), (4) Date: Mar. 12, 2014

(87) PCT Pub. No.: WO2012/167993

PCT Pub. Date: Dec. 13, 2012

(65) Prior Publication Data

US 2014/0175195 A1 Jun. 26, 2014

(30) Foreign Application Priority Data

Jun. 9, 2011 (DE) ..... 10 2011 077 276

(51) Int. Cl.
*F02M 61/18* (2006.01)
*F02M 51/06* (2006.01)

(52) U.S. Cl.
CPC .... *F02M 61/1806* (2013.01); *F02M 51/0625* (2013.01); *F02M 61/188* (2013.01); *F02M 61/1853* (2013.01)

(58) Field of Classification Search
CPC .... F02M 61/18; F02M 51/06; F02M 51/0625; F02M 61/1806; F02M 61/188
(Continued)

(56) References Cited

U.S. PATENT DOCUMENTS 4,629,127 A * 12/1986 Kawamura ..... F02M 61/10 239/489
4,971,254 A * 11/1990 Daly ..... F02M 51/061 239/396

(Continued)

FOREIGN PATENT DOCUMENTS

DE 19527846 1/1997
DE 102005036951 A1 2/2007

(Continued)

OTHER PUBLICATIONS

International Search Report issued in PCT/EP2012/057521, dated Jun. 29, 2012.

*Primary Examiner* — Chee-Chong Lee
(74) *Attorney, Agent, or Firm* — Norton Rose Fulbright US LLP; Gerard Messina

(57) ABSTRACT

A valve for metering a flowing medium, e.g., an injection valve for fuel-injection systems of internal combustion engines, is provided. In an embodiment, the valve has a sealing seat formed by a valve seat and a sealing head of a valve member able to be driven to execute lift motions. The valve has a plurality of spray orifices having hole-entry openings situated downstream from the sealing seat and sealable by the sealing seat. The valve has flow-through channels situated upstream from the sealing seat, which extend parallel to each other and discharge in front of the sealing seat. In order to achieve a unified upstream flow approach of all hole-entry openings of the spray orifices, e.g., if the number of spray orifices and flow-through channels differs, an upstream-flow shaper having at least one flow-through opening is situated between sealing seat and hole-entry openings of the spray orifices.

12 Claims, 3 Drawing Sheets

(58) Field of Classification Search
USPC ..... 239/585.4
See application file for complete search history.

(56) References Cited

U.S. PATENT DOCUMENTS

| | | | | | |
|---|---|---|---|---|---|
| 5,207,384 | A * | 5/1993 | Horsting | F02M 51/06 | 239/114 |
| 5,570,843 | A * | 11/1996 | Heyse | F02M 51/0682 | 239/585.1 |
| 5,685,485 | A * | 11/1997 | Mock | B05B 17/0646 | 239/102.2 |
| 5,967,423 | A * | 10/1999 | Sumida | F02M 61/10 | 239/533.12 |
| 2004/0188550 | A1 | 9/2004 | Saito et al. | | |
| 2005/0284965 | A1* | 12/2005 | Schneider | F02M 61/186 | 239/533.12 |
| 2009/0301442 | A1* | 12/2009 | Reiter | F02M 51/0682 | 123/490 |

FOREIGN PATENT DOCUMENTS

| | | |
|---|---|---|
| DE | 102005061424 | 7/2007 |
| EP | 1672213 | 6/2006 |
| EP | 1798410 | 6/2007 |
| JP | 2002130085 A | 5/2002 |
| JP | 2002210392 A | 7/2002 |
| JP | 2009520149 A | 5/2009 |
| WO | WO 9804828 | 2/1998 |

* cited by examiner

VALVE FOR METERING A FLOWING MEDIUM

FIELD

The present invention relates to a valve for metering a flowing medium, as well as an injection valve for fuel-injection systems of internal combustion engines.

BACKGROUND INFORMATION

A known fuel-injection valve, realized as the so-called multi-hole valve, for fuel-injection systems of internal combustion engines (See German Patent Reference No. DE 10 2005 036 951 A1) has a valve seat body which seals a hollow-cylindrical valve-seat support at the end, in which body a plurality of spray orifices having hole entry and hole exit openings are situated such that the hole entry openings in the inner body wall, and the hole exit openings in the outer body wall of the valve-seat body lie on a pitch circle in each case. A valve seat, in the form of an annular surface, which is concentric with respect to the axis of the valve-seat body, is developed at the inner body wall, which encloses all hole entry openings. The valve seat, together with a sealing head of a valve member able to be driven by means of an actuator such as an electromagnet, forms a sealing seat which seals the hole entry openings upstream. A guide member for the sealing head, which is provided with axially continuous flow-through channels and rests against the inner body wall of the valve seat at the end face, is situated in the valve-seat support. A valve chamber, which is connected to a fuel intake via fuel-supply ducts, is developed in the valve seat support upstream from the guide member, so that fuel under system pressure is present at the sealing seat.

In such a metering valve for a flowing medium, e.g., fuel, the finest possible atomization of the individually spray-discharged medium quantity requires that the flow-through channels are developed in such a way that no throttling of the medium flow occurs at the highest static through-flow, i.e., when the sealing head is lifted off the valve seat to the maximum extent. Given this demand and taking into account the required guide surfaces for the sealing head in the guide member and the cross-section of the flow-through channels, a certain fixed number of flow-through channels has shown to be advantageous.

If a number of spray orifices is selected that deviates from the number of flow-through channels for reasons of conditioning of the spray-discharged medium by the spray orifices, then unequal upstream-flow vectors of the medium at the individual hole entry openings of the spray orifices cause an uneven distribution of the medium flow spray-discharged via the individual spray orifices, as well as undesired scattering in the jet pattern of the media spray.

SUMMARY

Example embodiments of the present invention provide for a metering valve having an advantage that because of the upstream-flow shaper, which is disposed between sealing seat and spray orifices and has at least one flow opening, the media flow approaching the spray orifices is made uniform, even if there is a deviation between the number of flow-through channels on the one hand and spray orifices on the other.

Example embodiments of the present invention provide for a valve for metering a flowing medium, e.g., an injection valve for fuel-injection systems of internal combustion engines, comprising a sealing seat which is formed by a valve seat and a sealing head of a valve member able to be driven to execute lift motions; a plurality of spray orifices which include hole entry openings which are situated downstream from the sealing seat and are able to be closed by the sealing seat; and flow-through channels situated upstream from the sealing seat, which extend parallel to one another and discharge in front of the sealing seat. An upstream-flow shaper having at least one flow-through opening is situated between the sealing seat and the hole-entry openings of the spray orifices.

According to example embodiments of the present invention, the upstream-flow shaper is designed in the form of a flat upstream-flow disk. This makes it possible to place the upstream-flow shaper in the greatly limited space inside the valve, between sealing seat and hole entry openings of the spray orifices. The overall height of the upstream-flow disk is able to be kept very low because it will not be stressed in terms of structural mechanics and has to absorb only the forces resulting from the pressure drop. The upstream-flow disk is advantageously produced by shaping methods such as micro galvanic methods or laser cutting of sheet metal.

According to example embodiments of the present invention, a single flow opening, e.g., in the form of a circular central hole, is situated in upstream-flow disk, in the center of the disk. Because of the central hole, the hole entry openings of the spray orifices are approached by the flow uniformly from the valve center, i.e., from the direction of the valve axis, so that their flow approach is largely uniform.

According to example embodiments of the present invention, a plurality of flow-through openings are provided in the upstream-flow disk, which are developed as radially extending slots and aligned in the shape of a star in the upstream-flow disk, their number corresponding to the number of spray orifices. Such an upstream-flow shaper is used when the flow is meant to approach the hole entry openings of the spray orifices from the sides.

According to example embodiments of the present invention, the upstream-flow disk includes a multitude of flow-through openings, which are implemented as circular, preferably small, holes, so that a perforated sieve structure of the upstream-flow disk comes about. Because of this multitude of holes, the hole entry openings of the spray orifices are approached by the flow in completely uniform manner.

According to example embodiments of the present invention, the spray orifices are situated in a valve seat body which includes the valve seat and seals a hollow-cylindrical valve-seat support. A valve chamber which is in connection with a media inlet is formed in the valve-seat support, and the flow-through channels are open in the direction of the valve chamber. In an embodiment, the flow-through channels are developed in a hollow-cylindrical guide nipple of the valve-seat body, which projects into the valve-seat support, the flow-through channels being developed as axial grooves introduced into the cylinder wall of the guide nipple, and having a groove opening that points toward the nipple interior. In this example embodiment, all components required for the spray conditioning, e.g., spray orifices, valve seat and flow-through channels, are able to be realized in a single component during its production, e.g., in an MIM process.

DETAILED DESCRIPTION

Figure 1:
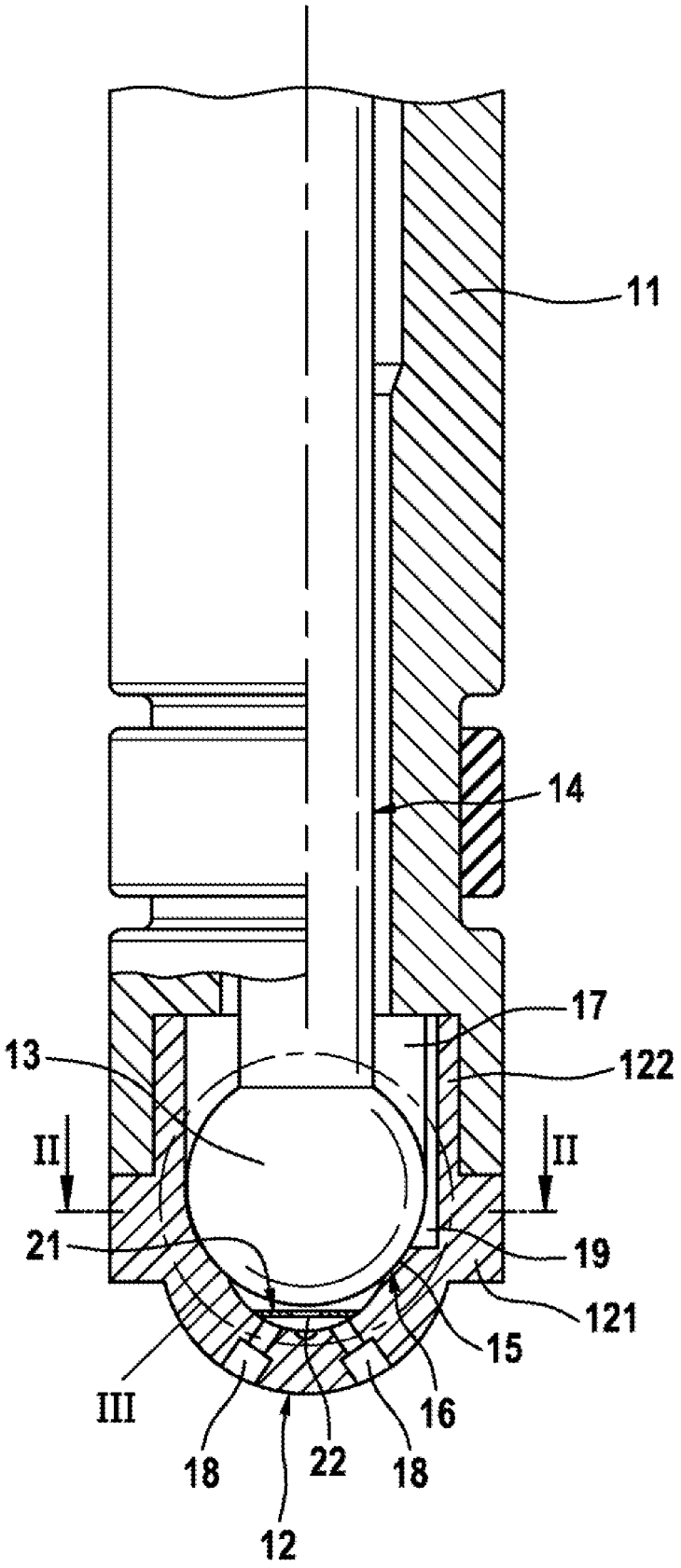
FIG. 1 shows in a cutaway view, a partial longitudinal section of a valve for a flowing medium of an embodiment according to the present invention.

In example embodiments, a valve, which is partially sketched in FIG. 1 as longitudinal section with its spray-discharged end, for a flowing medium is configured as injection valve for fuel-injection systems of internal combustion engines, for the injection of fuel into a combustion cylinder or into an air-aspiration pipe of the internal combustion engine. The valve has a sleeve-shaped valve-seat support 11, which projects from a valve housing (not shown here) and is sealed at its free end by a valve-seat body 12. Via a radial flange 121, valve-seat body 12 is sealingly situated at the annular end face of valve-seat support 11 and projects in form-fitting manner into valve-seat support 11 via a hollow-cylindrical guide nipple 122. Guide nipple 122 has guide surfaces 27 (see FIG. 2) for a sealing head 13 of a valve member 14 which is disposed in valve-seat support 11 so as to be axially displaceable, which valve member is able to be driven by means of an actuator (not shown here), such as an electromagnet, to perform lift motions. Sealing head 13 forms a sealing seat 16 together with a valve seat 15 developed on valve-seat body 12. A valve chamber 17 upstream from sealing seat 16 is in connection with a medium inflow (not shown here) formed in the valve housing, so that medium under system pressure, which is fuel if an injection valve is involved, is available at sealing seat 16.

In example embodiments, the valve developed as multi-hole valve is provided with a plurality of spray orifices 18 having hole entry openings 181, which are situated downstream from sealing seat 16. Spray orifices 18 having hole axes that are inclined toward the valve axis are developed in valve-seat body 12 in such a way that hole-entry openings 181 lying in the inner body wall of valve-seat body 12 at a distance from each other lie on a first so-called pitch circle, that is so say, they have the same distance from each other in the circumferential direction of the circle.

In example embodiments, situated upstream from sealing seat 16 are flow-through channels 19 which are connected to valve chamber 17, extend in parallel to each other and discharge in front of sealing seat 16. All flow-through channels 19 lie on a second circle, at a distance from each other, the distances between flow-through channels 19 once again being of identical size in the circumferential direction of the circle. The second so-called pitch circle has a considerably larger diameter than the first pitch circle for hole-entry openings 181. Flow-through channels 19 are situated in the cylinder wall of guide nipple 122 of valve-seat body 12 and are developed as axial grooves 20 introduced into the cylinder wall of guide nipple 122, and they have groove openings that extend between guide surfaces 27.

Figure 2:
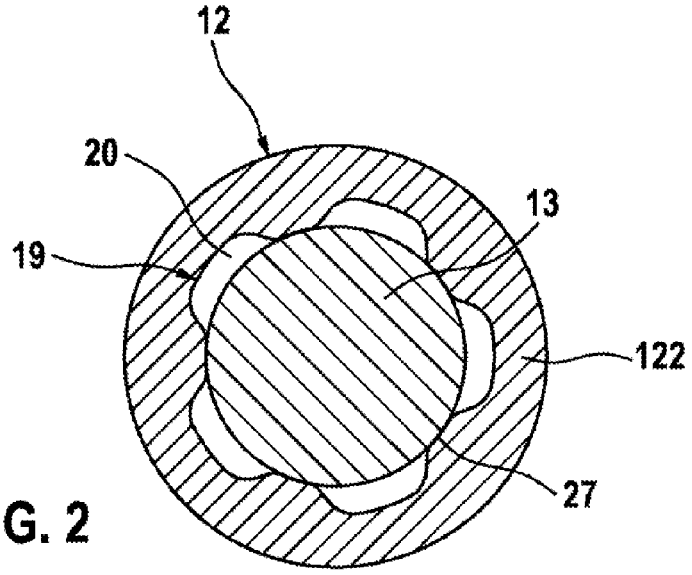
FIG. 2 shows a section along line II-II in FIG. 1 of an embodiment according to the present invention.

The sectional view of FIG. 2 shows a total of five flow-through channels 19, i.e., five axial grooves 20, situated in guide nipple 122 as the optimal number of flow-through channels 19. By way of example, on the other hand, valve-seat body 12 has a total of six spray orifices 18, of which only two can be seen in the sectional view of FIG. 1. In order to equalize the unequal flow approach of spray orifices 18 by the medium, which is due to the different number of flow-through channels 19 and spray orifices 18, i.e., to achieve uniform upstream-flow vectors at hole-entry openings 181 of spray orifices 18, an upstream-flow shaper 21 is situated between sealing seat 16 and hole-entry openings 181 of spray orifices 18, which has at least one flow-through opening 22. Due to the very restricted installation space between valve seat 15 and hole-entry openings 181 in valve-seat body 12, upstream-flow shaper 21 is developed as flat upstream-flow disk 23, which is fixed in place inside valve-seat body 12 on a wall region of valve-seat body 12 between valve seat 15 and hole-entry openings 181.

Figure 3:
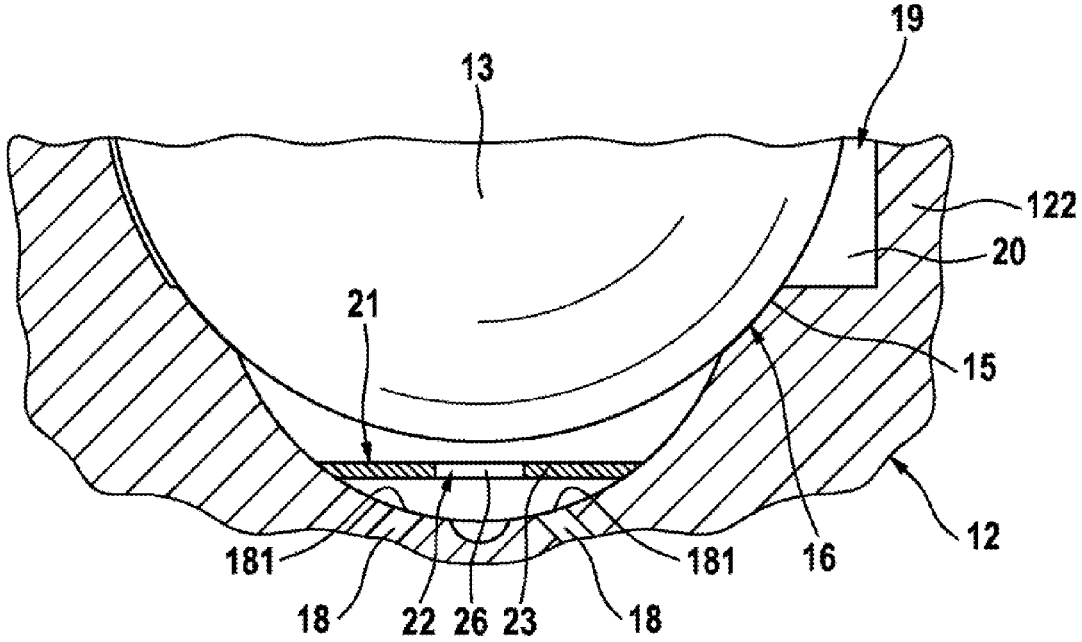
FIG. 3 shows an enlarged view of detail III in FIG. 1 of an embodiment according to the present invention.

The view of upstream-flow disk 23 shown in section in FIG. 1 and in an enlarged view in FIG. 3 has a single flow-through opening 22, which is situated in the center of the disk as circular central hole 26.

Figure 4:
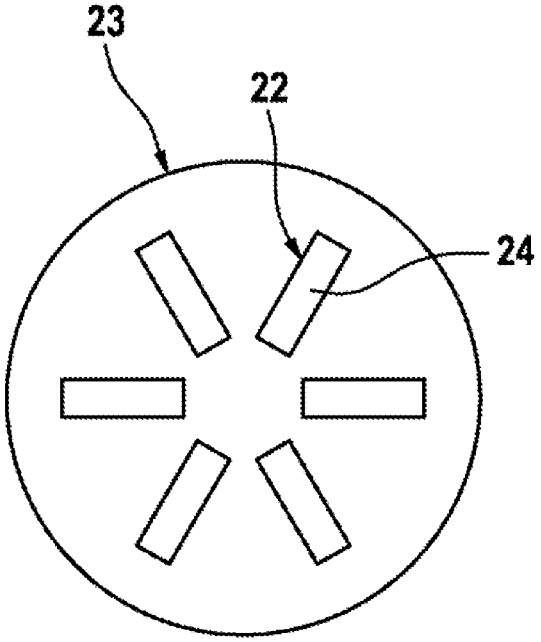
FIG. 4 shows a plan view of an upstream-flow shaper in the valve of FIG. 1 according to an embodiment of the present invention.
Figure 5:
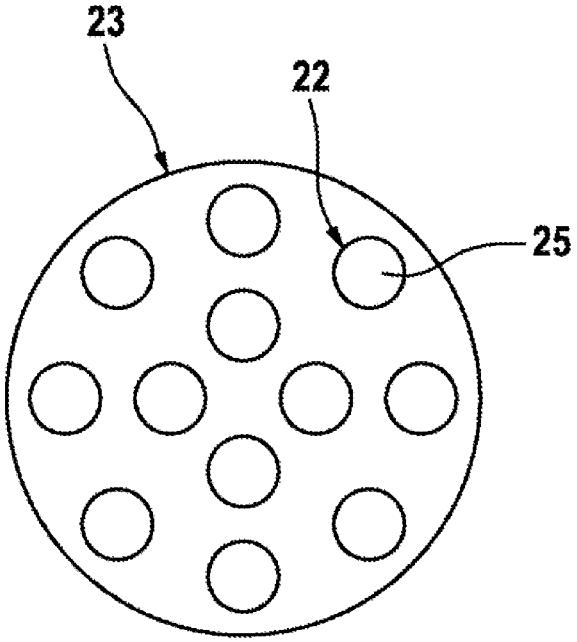
FIG. 5 shows plan view of another upstream-flow shaper in a valve according to an embodiment of the present invention.

FIGS. 4 and 5 show two additional embodiment variants of upstream-flow disk 23 in a plan view.

In FIG. 4, an upstream-flow disk 23 is provided with multiple flow-through openings 22, which are developed as radially extending slots 24 and aligned in star form in upstream-flow disk 23. The number of slots 24 corresponds to the number of spray orifices 18, i.e., amounts to six in the exemplary embodiment. This upstream-flow disk 23 is used when it is advantageous to have the hole-entry openings 181 of spray orifices 18 exposed to a lateral flow.

In FIG. 5, an upstream-flow disk 23 features a multitude of flow-through openings 22. Flow-through openings 22 are developed as preferably small holes 25 and in the form of a circle, so that upstream-flow disk 23 has the structure of a perforated screen. This large number of small holes achieves a completely uniform flow approach of hole entry openings 181.

The present invention is not restricted to the described example embodiments of a fuel-injection valve. For example, any gaseous or liquid medium in which spray conditioning of the spray-discharged medium quantity is to be achieved can be spray-discharged in metered manner with the aid of the valve. The valve, e.g., may be used to inject a urea-water solution into the exhaust-gas tract of the internal combustion engine in order to obtain a reduction of nitrogen oxides in the exhaust gas.

What is claimed is:

1. A valve for metering a flowing medium, comprising:

a valve-seat body including an inner surface situated at a spray-discharge end of the valve;

a sealing seat, formed by a valve seat and a sealing head of a valve member able to be driven to execute lift motions, wherein the valve seat is formed on the inner surface of the valve-seat body;

a plurality of spray orifices including hole entry openings situated downstream from the sealing seat and able to be closed by the sealing seat, wherein the hole entry openings are formed on the inner surface of the valve-seat body;

flow-through channels situated upstream from the sealing seat, which extend parallel to one another and discharge in front of the sealing seat; and an upstream-flow shaper having at least one flow-through opening is situated between the sealing seat and the hole entry openings of the plurality of spray orifices, wherein the upstream-flow shaper is developed as a flat upstream-flow disk, wherein the upstream-flow shaper and the valve member contact the inner surface of the valve-seat body, wherein the inner surface of the valve-seat body is situated in an interior of the valve seat body, wherein, at a location of the contact between the upstream-flow shaper and the valve member, the inner surface of the valve seat body is exposed to the flowing medium, and wherein the upstream-flow shaper is fixedly connected to the inner surface of the valve seat body.

2. The valve as recited in claim 1, wherein the flat upstream-flow disk has exactly one single flow-through opening, the single flow-through opening being disposed in centered manner in the upstream-flow disk in the form of a central hole.

3. The valve as recited in claim 1, wherein a plurality of flow-through openings is provided in the flat upstream-flow disk, the plurality of flow-through openings being radially extending slots and aligned in the shape of a star in the flat upstream-flow disk, the number of slots matching the number of spray orifices of the plurality of spray orifices.

4. The valve as recited in claim 1, wherein the flat upstream-flow disk has a multitude of flow-through openings, which are developed as circular holes.

5. The valve as recited in claim 4, wherein the multitude of flow-through openings are small, circular holes.

6. The valve as recited in claim 1, wherein the hole entry openings of the plurality of spray orifices are situated on a first circle, and the flow-through channels are situated on a second circle, set apart from each other, the second circle having a larger diameter than the first circle.

7. The valve as recited in claim 6, wherein the distances between the hole entry openings and the distances between the flow-through channels are of equal size.

8. The valve as recited in claim 1, wherein the plurality of spray orifices are situated in the valve-seat body, which includes the valve seat and seals a hollow-cylindrical valve-seat support, and a valve chamber, which is connected to a medium intake, is formed in the valve-seat support, and the flow-through channels are connected to the valve chamber.

9. The valve as recited in claim 8, wherein the valve-seat body includes a hollow-cylindrical guide nipple which projects into the valve-seat support and includes guide surfaces for the sealing head of the valve member, and the flow-through channels are situated in the cylinder wall of the hollow-cylindrical guide nipple.

10. The valve as recited in claim 9, wherein the flow-through channels are developed as axial grooves, which are worked into the cylinder wall of the guide nipple and have groove openings that extend between the guide surfaces.

11. The valve as recited in claim 8, wherein the flat upstream-flow disk in the valve-seat body is fixed in place on a wall region of the valve-seat body that is situated between the valve seat and the hole entry openings of the plurality of spray orifices.

12. The valve as recited in claim 1, wherein the valve is an injection valve for fuel-injection systems of internal combustion engines.

* * * * *